US006463849B2

(12) United States Patent
Mizutani

(10) Patent No.: US 6,463,849 B2
(45) Date of Patent: Oct. 15, 2002

(54) WIRE BUNDLING AND REMOVING APPARATUS AND METHOD

(75) Inventor: Tatsuya Mizutani, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 6 days.

(21) Appl. No.: 09/825,043

(22) Filed: Apr. 4, 2001

(65) Prior Publication Data

US 2001/0032680 A1 Oct. 25, 2001

(30) Foreign Application Priority Data

Apr. 5, 2000 (JP) ..... 2000-103090

(51) Int. Cl.[7] ..... B30B 13/00

(52) U.S. Cl. ..... 100/35; 29/33 M; 29/566.3; 53/590; 100/7; 269/58; 269/903

(58) Field of Search ..... 100/7, 9, 34, 35; 53/585, 590; 29/33 M, 566.3, 755, 825; 269/13, 31, 56, 58, 237, 238, 903

(56) References Cited

U.S. PATENT DOCUMENTS

| | | | | |
|---|---|---|---|---|
| 3,960,371 A | * | 6/1976 | McKenzie | 269/58 |
| 4,156,961 A | | 6/1979 | Agoh | |
| 4,602,976 A | | 7/1986 | Fukuda et al. | |
| 4,704,775 A | | 11/1987 | Cross | |
| 4,706,948 A | * | 11/1987 | Kroecher | 269/58 |
| 5,203,260 A | | 4/1993 | Fukuda et al. | |

FOREIGN PATENT DOCUMENTS

| | | |
|---|---|---|
| JP | 5-229519 | 9/1993 |

* cited by examiner

*Primary Examiner*—W. Donald Bray
(74) *Attorney, Agent, or Firm*—Greenblum & Bernstein, P.L.C.

(57) ABSTRACT

There is provided an apparatus for bundling a plurality of wires placed on a receiving plate. The apparatus is provided with a bundling pawl mechanism that includes a plate and a pair of pawl members. The pawl members are respectively supported at pivot points provided on the plate in spaced-apart relation and interconnected with driving units for opening and closing movement. The pawl members also respectively extend beyond an edge portion of the plate. A wire bundling region is formed between inner surfaces of the pawl members and the edge portion of the plate when at least one of the pawl members rotates toward the other of the pawl members in a closing direction. The bundling pawl mechanism further includes a wire catch prevention member that projects into the wire bundling region from an angled inner corner formed between the inner surface of the at least one pawl member and the edge portion of the plate when the at least one pawl member rotates in the closing position. With the above construction, since the wire catch prevention member projects into the bundling region from the inner corner, even if the angle of the inner corner becomes acute as the wire bundling region becomes narrower, the wires can be prevented from becoming caught in the angled inner corner, thereby preventing the wires from becoming damaged in the angled inner comer.

18 Claims, 10 Drawing Sheets

WIRE BUNDLING AND REMOVING APPARATUS AND METHOD

BACKGROUND OF THE INVENTION

1. Field of the Invention

The present invention relates to an apparatus for and a method of bundling a plurality of electric wires, and in particular to an apparatus for and a method of automatically bundling wires which have been cut into a predetermined length and placed on a tray, then removing them from the tray.

2. Description of the Related Art

Conventionally, electric wires are cut into a predetermined length and crimped with terminal fittings at their ends by an automatic wire cutting and terminal crimping machine, then placed on a receiving tray. After these processes have been performed, the terminal-crimped wires are bundled in a predetermined quantity and removed from the tray for the next process. An example of a conventional wire bundling apparatus that automatically performs these processes is disclosed in Japanese Laid-Open Patent Publication No. 5-229519.

In such application, as shown in FIG. 10(A), the wire bundling apparatus is provided with a bundling pawl mechanism 2 disposed laterally of the receiving tray 1. The bundling pawl mechanism 2 has a pair of upper and lower pawl members 5*a*, 5*b* that move toward and away from each other upon actuation of cylinders 3, 4. As shown in FIGS. 10(B) and 10(C), the upper and lower pawl members 5*a*, 5*b* enclose and bundle the wires W positioned on the tray 1, and then remove them from the tray 1 by rotating the bundling pawl mechanism 2 while actuating another cylinder provided as a rotating mechanism (not shown).

However, a problem with the conventional bundling apparatus of this type is that some of the wires W may be caught in angled inner corners 7 formed by the overlying upper and lower pawl members 5*a*, 5*b* during the bundling process as shown in FIG. 10(B), and may become damaged or broken. Another problem is that since the wire bundling operation is done by moving the upper and lower pawl members 5*a*, 5*b* toward each other in a closing direction, the pawl members 5*a*, 5*b* must be disposed adjacent the tray as illustrated. Because of this, the wires W, which are fed downwardly from a wire feeding mechanism 6 to the tray 1 as shown in FIG. 10(A), may interfere with the upper pawl member 5*a*, thus resulting in a situation where all the required wires W are not properly fed on to the tray 1. Still another problem is that the wires W dropped from the wire feeding mechanism 6 may lay scattered on the tray 1 because of the momentum they gather while falling. Thus, the pawl members 5*a* may fail to enclose all the wires W during the bundling operation.

SUMMARY OF THE INVENTION

The present invention has been developed after taking the above problems into consideration, and aims to ensure that a pair of pawl members bundles all the required wires to be fed downwardly to the receiving tray, without damaging them.

To solve the above problems, the present invention provides an apparatus for bundling a plurality of wires placed on a receiving plate. The apparatus is provided with a bundling pawl mechanism that includes a plate and a pair of pawl members. The pawl members are respectively supported at pivot points provided on the plate in spaced-apart relation and are interconnected with driving units for opening and closing movement. The pawl members also respectively extend beyond an edge portion of the plate. A wire bundling region is formed between inner surfaces of the pawl members and the edge portion of the plate when at least one of the pawl members rotates toward the other of the pawl members in a closing direction. The bundling pawl mechanism further includes a wire catch prevention member configured to project into the wire bundling region from an angled inner corner formed between the inner surface of the at least one pawl member and the edge portion of the plate when the at least one pawl member rotates in the closing position.

With the above construction, the pair of pawl members are disposed in spaced apart relation, thereby forming a wire accommodating space therebetween, which is large enough to receive all the required wires when they are in an opening condition. Also, since the wire catch prevention member pushes or projects into the bundling region from the angled inner corner, even if the angle of the inner corner becomes acute as the wire bundling region becomes narrower, the wires can be prevented from becoming caught in the angled inner corner, thereby preventing the wires from becoming damaged in the angled inner corner.

According to a preferred embodiment of the present invention, the wire catch prevention member is pivotably supported at a pivot point provided on the plate. The at least one pawl member has an engaging portion that operatively engages and pushes the wire catch prevention member into the wire bundling region when the at least one pawl member rotates in the closing direction. Thus, the projecting or pushing operation of the wire catch prevention member can be done simply by shifting the at least one pawl member in the closing direction.

In another aspect of the present invention, the apparatus further includes a movable frame that supports and moves the bundling pawl mechanism between a retracted position which is located outwardly of the receiving tray and a bundling position which is located below the receiving tray. The bundling pawl mechanism is configured to be lifted from the bundling position to a wire receiving position which corresponds to the receiving tray via a lifting mechanism, so that the pawl members can receive the wires placed on the receiving tray. Preferably, the wire receiving position is laterally adjacent the receiving tray.

With this construction, the pawl members can be disposed in the retracted position away from the receiving tray when the wires are fed downwardly onto the tray. Thus, the wires which are to be fed downwardly can be prevented from interfering with the pawl members, thereby preventing the wires from inadvertently coming out of the receiving tray. Further, the bundling pawl mechanism is shifted to the bundling position below the receiving tray, and then lifted from there. Therefore, the pawl members can shift toward the bundling position without hooking or entangling the wires, and can receive the wires therebetween with certainty, when the bundling pawl mechanism is lifted to the wire receiving position.

In a further aspect of the present invention, the apparatus further includes a rotating mechanism that supports the bundling pawl mechanism so that the bundling pawl mechanism rotates upwardly from the receiving position when the bundling pawl mechanism removes the wires from the receiving tray. With the above construction, since the wires enclosed and bundled by the pawl members can be removed from the receiving tray by rotating the pawl members upwardly, even if the wires hang downwardly from the bundling pawl mechanism, they can be prevented from interfering with surrounding units.

In a further aspect of the present invention, the apparatus further includes a movable frame that supports and moves the bundling pawl mechanism between a retracted position which is located outwardly of the receiving tray and a bundling position which is located below the receiving tray. The at least one pawl member is disposed farther away from the receiving tray than the other of the pawl members in a direction in which the bundling pawl mechanism moves from the retracted position to the bundling position. The at least one pawl member is configured to contact the wires placed on the receiving tray when the bundling pawl mechanism moves to the bundling position, so that the wires can be gathered at one location on the receiving tray. With the above construction, when the bundling pawl mechanism moves to the bundling position, the pawl member disposed farther away from the receiving tray contacts the wires scattered on the receiving tray, and gathers them at one side or location of the receiving tray. Accordingly, the pawl members can enclose and bundle all the required wires with certainty.

Furthermore, the present invention provides a method of bundling a plurality of wires which are to be fed on a receiving plate successively and removing the wires from the receiving tray. The method includes: providing a bundling pawl mechanism having a plate and a pair of pawl members supported on the plate for opening and closing movement; gathering the wires at one location on the receiving tray by moving one of the pawl members into contact with the wires placed on the receiving tray while advancing the bundling pawl mechanism from a retracted position which is located outwardly of the receiving tray to a bundling position which is located below the receiving tray; lifting the bundling pawl mechanism from the bundling position to a wire receiving position which is located laterally adjacent the receiving tray, whereby the gathered wires can be received between the pawl members when the bundling pawl mechanism is lifted; closing the pawl members and forming a wire bundling region between inner surfaces of the pawl members and an edge portion of the plate, thereby enclosing and bundling the wires in the wire bundling region; retracting the bundling pawl mechanism to a position where the pawl members are disposed outwardly of the receiving tray; and opening the pawl members to release and permit removal of the bundled wires. Preferably, the method also includes: providing a wire catch prevention member in an angled inner corner formed between the inner surface of at least one of the pawl members and an edge portion of the plate; and projecting the wire catch prevention member into the wire bundling region from the angled inner corner when the at least one pawl member moves in a closing direction, so that the wires can be prevented from becoming caught in the angled inner corner.

Still furthermore, the present invention provides an apparatus for bundling a plurality of wires placed on a receiving tray. The apparatus is provided with a bundling pawl mechanism that includes a plate having an edge portion and a pair of pawl members pivotably supported on the plate and extending beyond the edge portion. The pawl members forms a wire accommodating region between inner surfaces thereof and the edge portion when the pawl members are positioned away from each other in a opening condition, and forms a wire bundling region between the inner surfaces thereof and the edge portion when at least one of the pawl members rotates toward the other of the pawl members in a closing direction. The at least one pawl member is configured to form an angled inner corner between the inner surface thereof and the edge portion when the at least one pawl member rotates toward the other of the pawl members in the closing direction. The bundling pawl mechanism further includes a wire catch prevention member configured to form an obtuse angle between the inner surface of the at least one pawl member and the edge portion when the at least one pawl member rotates toward the other of the pawl members to enclose and bundle the wires. Accordingly, the wires can be prevented from becoming caught in the angled inner corner, thereby preventing the wires from becoming damaged while the wires are being enclosed and bundled.

In another aspect of the present invention, the wire catch prevention member is configured to project from the angled inner corner into the wire bundling region when the at least one pawl member rotates toward the other of the pawl members in the closing direction. As a result, the obtuse angle can be formed between the inner surface of the at least one pawl member and the edge portion, thereby preventing the wires from becoming caught in the angled inner corner.

In a further aspect of the present invention, the wire catch prevention member is pivotably mounted on the plate between the pawl members provided in spaced-apart relation, and extends to overly the at least one pawl member in intersecting relation. Because of this construction, the wire catch prevention member can be pushed into the wire bundling region when the at least one pawl member rotates toward the other of the pawl members. Preferably, the wire catch prevention is positioned in the inner angled corner when the pawl members are in the opening condition, and rotates into the wire bundling region when the at least one pawl member rotates toward the other of the pawl members while decreasing the angle of the inner angled corner.

According to a preferred embodiment of the present invention, the wire catch prevention member is biased toward the at least one pawl member and away from the other of the pawl members, and the at least one pawl member is configured to push the wire catch prevention member while sliding along the wire catch prevention member when the at least one pawl member rotates toward the other of the pawl members in the closing direction.

In a further aspect of the present invention, the at least one pawl member has an engaging portion that operatively engages and rotates the wire catch prevention member into the wire bundling region when the at least one pawl member rotates in the closing direction. The wire catch prevention member is configured to push the wires toward the center of the wire bundling region during its movement.

In a further aspect of the present invention, the apparatus further includes a movable frame that supports and moves the bundling pawl mechanism from a retracted position to a wire bundling position. The at least one pawl member is configured such that its protruding end contacts and moves the wires placed on the receiving tray when the bundling pawl mechanism shifts toward the wire bundling position, so that the wires can be gathered at one location on the receiving tray.

BRIEF DESCRIPTION OF THE DRAWINGS

The present invention is further detailed in the description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

Figure 1:
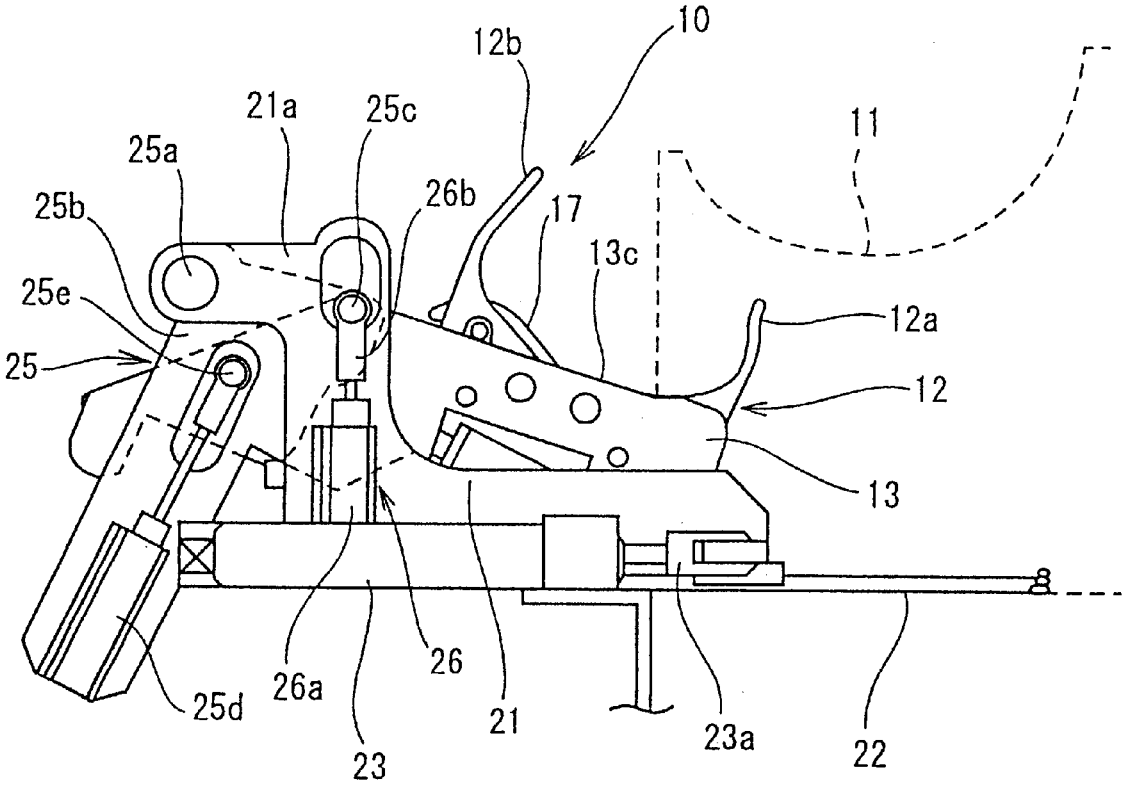
FIG. 1 illustrates a preferred embodiment of the wire bundling apparatus according to the present invention.
Figure 2:
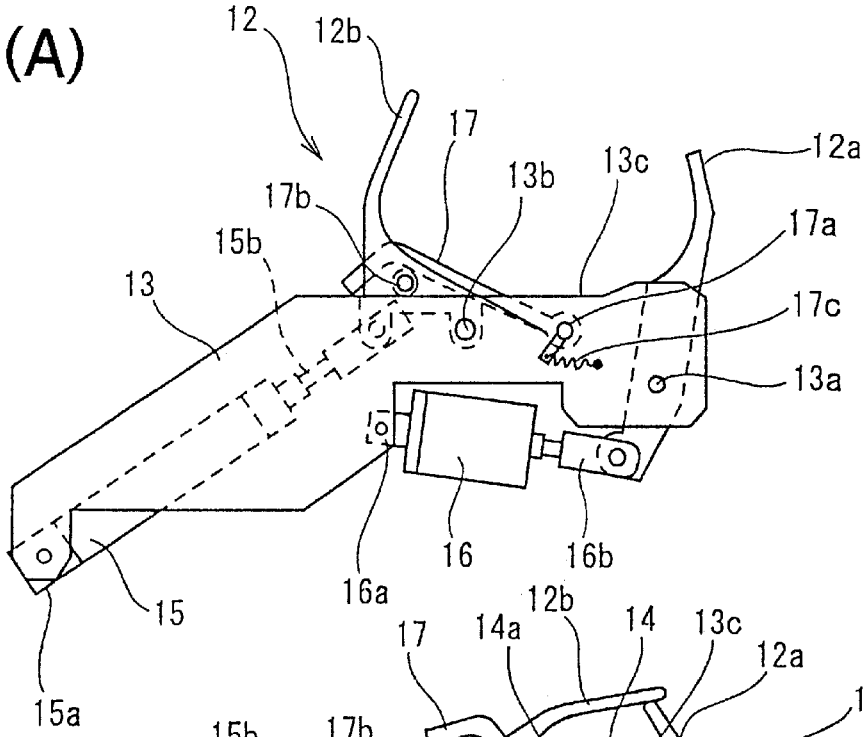
FIGS. 2(A) through 2(C) illustrate how the pawl members of the bundling pawl mechanism operate.
Figure 2:
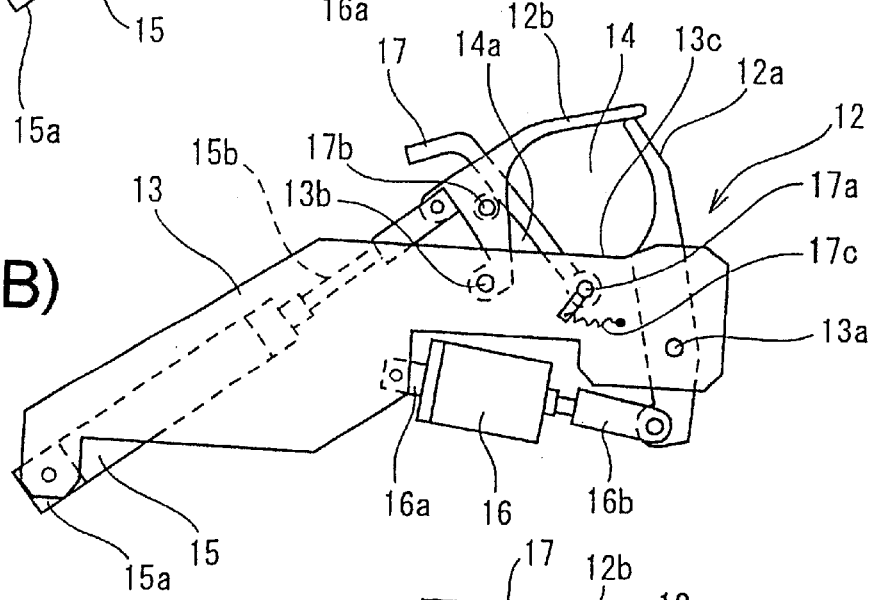
Figure 2:
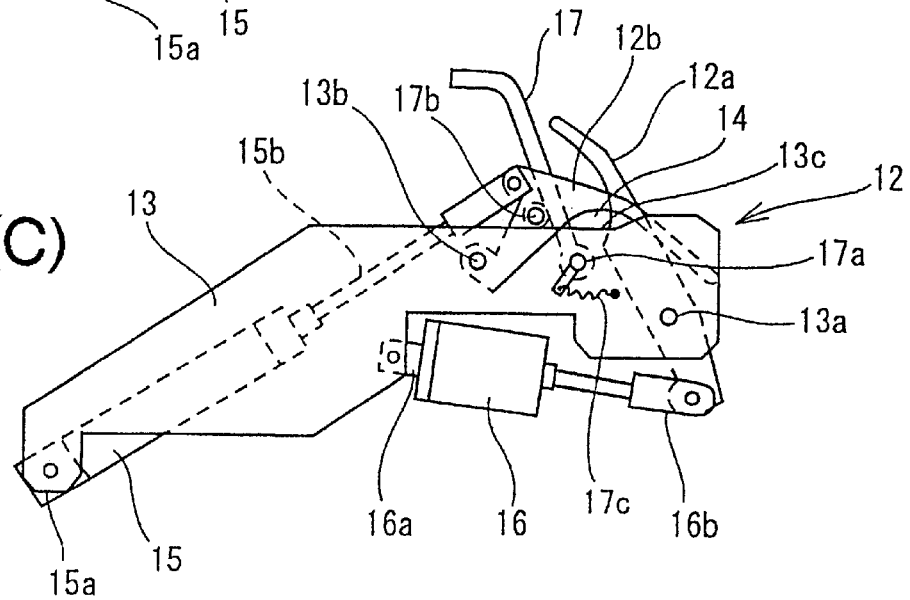
Figure 3:
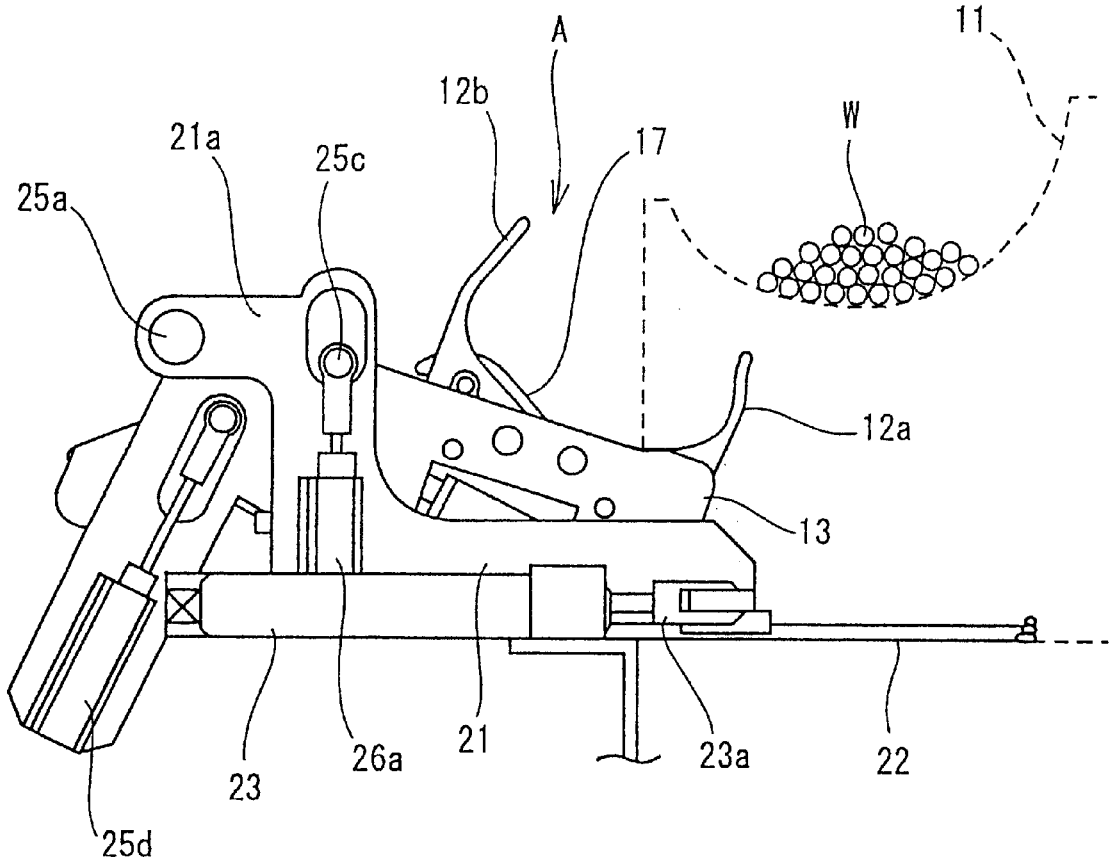
FIG. 3 illustrates the condition in which the bundling pawl mechanism is in a retracted position.
Figure 4:
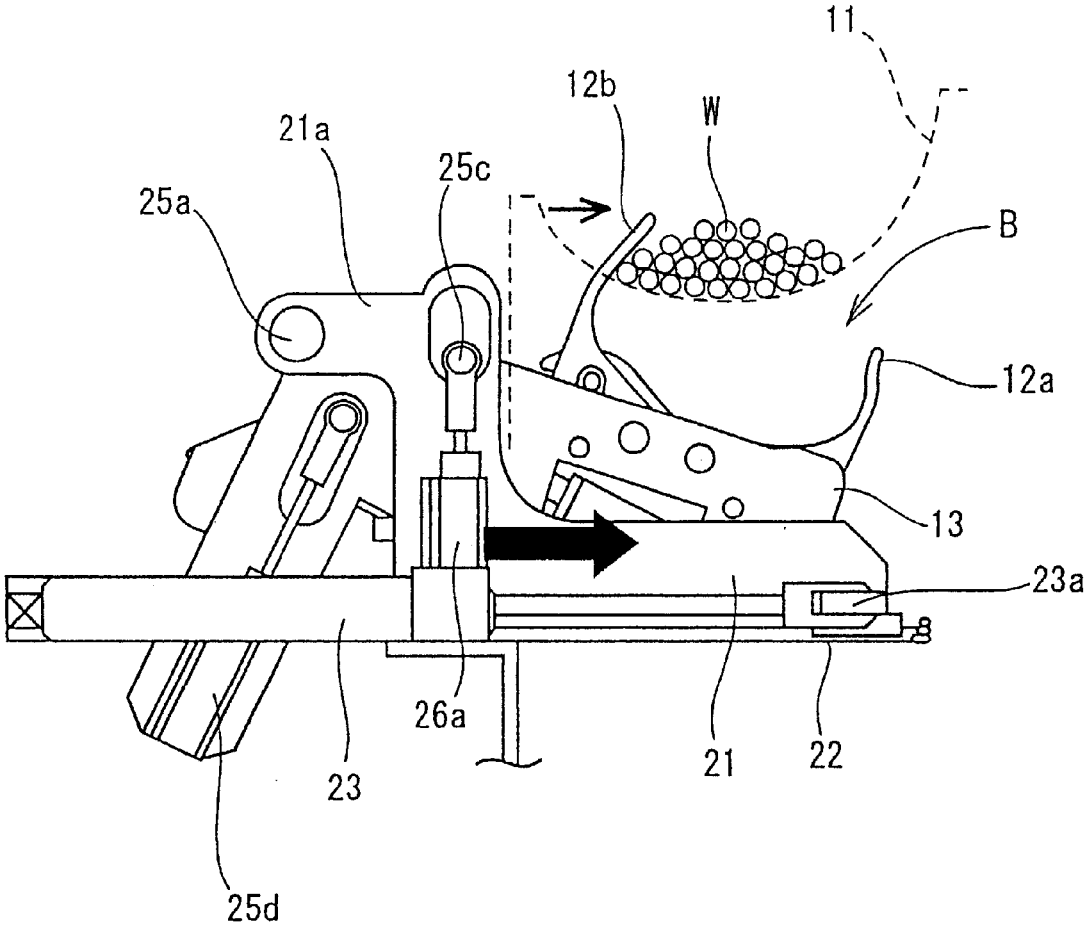
FIG. 4 illustrates the condition in which the bundling pawl mechanism is advanced to a wire bundling position.

FIGS. 1 through 9 show the preferred embodiments of a wire bundling apparatus 10 of the present invention. As shown in FIGS. 1 and 3, the wire bundling apparatus 10 is disposed laterally of a receiving tray 11 on which wires W, cut into a predetermined length and crimped with terminal fittings, are to be placed. The bundling apparatus 10 has a bundling pawl mechanism 12 for bundling the wires W directly and a movable frame 21 that supports and moves the bundling pawl mechanism 12 from a retracted position A (FIG. 3) to a bundling position B (FIG. 4).

As shown in FIGS. 2(A) through 2(C), the bundling pawl mechanism 12 includes a support plate 13 that extends in a longitudinal direction and a pair of pawl members 12*a*, 12*b* that are respectively supported at spaced locations on the support plate 13 for opening and closing movement of at least one of the pawl members 12*a*, 12*b* with respect to the other. More specifically, the pawl members 12*a*, 12*b* are respectively supported at pivot points 13*a*, 13*b* provided on the plate 13 and extend beyond the plate 13 in a direction away from the longitudinal direction.

In a preferred embodiment, two support plates 13 are provided, each plate 13 disposed at either side of the pawl members 12*a*, 12*b*. The pawl members 12*a*, 12*b* are disposed in the longitudinal direction, with their upper ends projecting respectively past upper edge portions 13*c* of the plate 13. The pawl members 12*a*, 12*b* are pivotably supported on respective pivotable shafts (pivot points 13*a*, 13*b*) that extend through the plates 13.

As shown in FIGS. 2(B) through 2(C), when the upper end of the pawl member 12*b* (disposed rearwardly in the longitudinal direction) shifts downwardly toward the pawl member 12*a* (disposed forwardly in the longitudinal direction) which is positioned nearer to the receiving tray 11, the pawl members 12*a*, 12*b* intersect to close, thereby forming a bundling region 14 to enclose and bundle the wires W between the inner surfaces of the pawl members 12*a*, 12*b* and the upper edge portion 13*c* of the plate 13. An open-ended slit or slot (not shown) is formed to extend downwardly from the upper end of the pawl member 12*b*, and is configured and dimensioned to receive the pawl member 12*a* therein, thereby allowing the pawl members 12*a*, 12*b* to intersect as best shown in FIGS. 2(B) and 2 (C) when they shift toward each other in a closing direction. The open-ended slit or slot may be formed by forming a slot in a unitary, single pawl member 12*b*. Alternatively, the slot may be formed, for example, by a pair of spaced-apart pawl members 12*b*.

Fixed at the rear end of the support plate 13 is a base portion 15*a* of a first cylinder 15 which is provided as a driving mechanism to permit the opening and closing movement of the pawl member 12*b*. The piston rod 15*b* of the first cylinder 15 is operatively connected to the pawl member 12*b* at a location between the pivot point 13*b* and the upper end (or protruding end) of the pawl member 12*b*, thus moving the pawl member 12*b* in response to its advancing and retracting movement. Furthermore, fixed at an intermediate portion of the support plate 13 is a base portion 16*a* of a second cylinder 16 which is provided as a driving mechanism to permit the opening and closing movement of the pawl member 12*a*. The piston rod 16b of the second cylinder 16 is operatively connected to the lower end of the pawl member 12*a*, thus moving the pawl member 12*a* in response to its advancing and retracting movement.

FIG. 2(A) illustrates the maximum opening condition of the pawl members 12*a*, 12*b*, and FIG. 2(C) illustrates the minimum opening condition (i.e. maximum closed condition). The opening and closing stroke of the pawl member 12*b* is set to be greater than that of the pawl member 12*a* so that the pawl member 12*b* shifts or rotates downwardly to overlie the pawl member 12*a* when it advances in the closing direction.

The bundling pawl mechanism 12 is further provided with a wire catch prevention member 17 for preventing the wires W from becoming caught and damaged. The catch prevention member 17 is formed from an elongated member, and is pivotably supported at the lower end of the elongated member at a pivot point 17*a* positioned at an intermediate position between the pivoting points 13*a*, 13*b* of the pawl members 12*a*, 12*b*.

In a preferred embodiment, the catch prevention member 17 has a generally round cross-sectional shape, and is positioned for movement within the slot so that it intersects with the pawl member 12*b*. However, it will be apparent that the prevention member 17 may have any desired shape.

The prevention member 17 rotates to project toward the pawl member 12*a*, i.e., into the bundling region 14, from an angled inner corner 14*a* formable between the upper edge portion 13*c* of the plate 13 and the inner surface of the pawl member 12*b*, thereby forming an obtuse angled inner corner 14*b* between the upper edge portion 13*c* of the plate 13 and the inner surface of the pawl member 12*b*. This ensures that the angled inner corner 14*b* that engages the wires always remains obtuse no matter how acute the angled inner corner 14*a* becomes as the pawl member 12*b* rotates toward the pawl member 12*a*, thereby preventing the wires W from becoming caught therein. Provided at an intermediate portion of the pawl member 12*b* is an engaging portion 17*b* that operatively engages an intermediate portion of the catch prevention member 17. Because of this, the catch prevention member 17 is pushed into the bundling region 14 as the pawl member 12*b* rotates in the closing direction. The engaging portion 17*b* is in the form of a protrusion, and is disposed at the inner sides of the pawl member 12*b*. Additionally, a spring member 17*c* is attached to the prevention member 17 at a position adjacent to, but spaced from, the pivot point 17*a* of the prevention member 17. The spring member 17*c* biases the prevention member toward the pawl member 12*b* side and against the projecting direction of the prevention member 17.

In a preferred embodiment, the engaging portion 17*b* extends in a direction transverse to the length of the elongated member and to the longitudinal direction so that it engages the intermediate portion along the length of the elongated member. Thus, as illustrated in FIGS. 2(A) through 2(C), the pawl member 12*b* pushes or urges the wire catch prevention member 17 toward the pawl member 12*a*, while sliding along the length of the elongated member when it rotates in the closing direction.

As shown in FIGS. 1 and 3, the movable frame 21 is provided to move the bundling pawl mechanism 12 in the longitudinal direction, and to support the bundling mechanism 12 indirectly via a rotating mechanism 25 and a lifting mechanism 26 to be described later. The movable frame 21 is seated so that it can advance and retract horizontally along a base portion 22 disposed downwardly of the receiving tray 1. The movable frame 21 is connected to a piston rod 23*a* of a third cylinder 23 which is fixed to the base portion 22 as an advance and retract driving mechanism. Consequently, when the third cylinder 23 is actuated, the pawl members 12*a*, 12*b* move between the retracted position A which is to the rear of the tray 11(FIG. 3) and the bundling position B which corresponds to the location of the tray 11(FIG. 4), along with the movement of the movable frame 21. The receiving tray 11 has an open ended slit or slot (not shown) which extends in the longitudinal direction and which is dimensioned to receive the pawl members 12*a*, 12*b* therein when the bundling pawl mechanism 12 moves to the bundling position B.

As shown in FIG. 4, when the bundling pawl mechanism 12 moves from the retracted position A to the bundling position B with the pawl members 12*a*, 12*b* disposed in the opening condition, the upper end of the rearwardly disposed pawl member 12*b* projects into a wire-accumulating region so that it contacts the wires W positioned on the receiving tray 1 and gathers them at one side or location.

Figure 8:
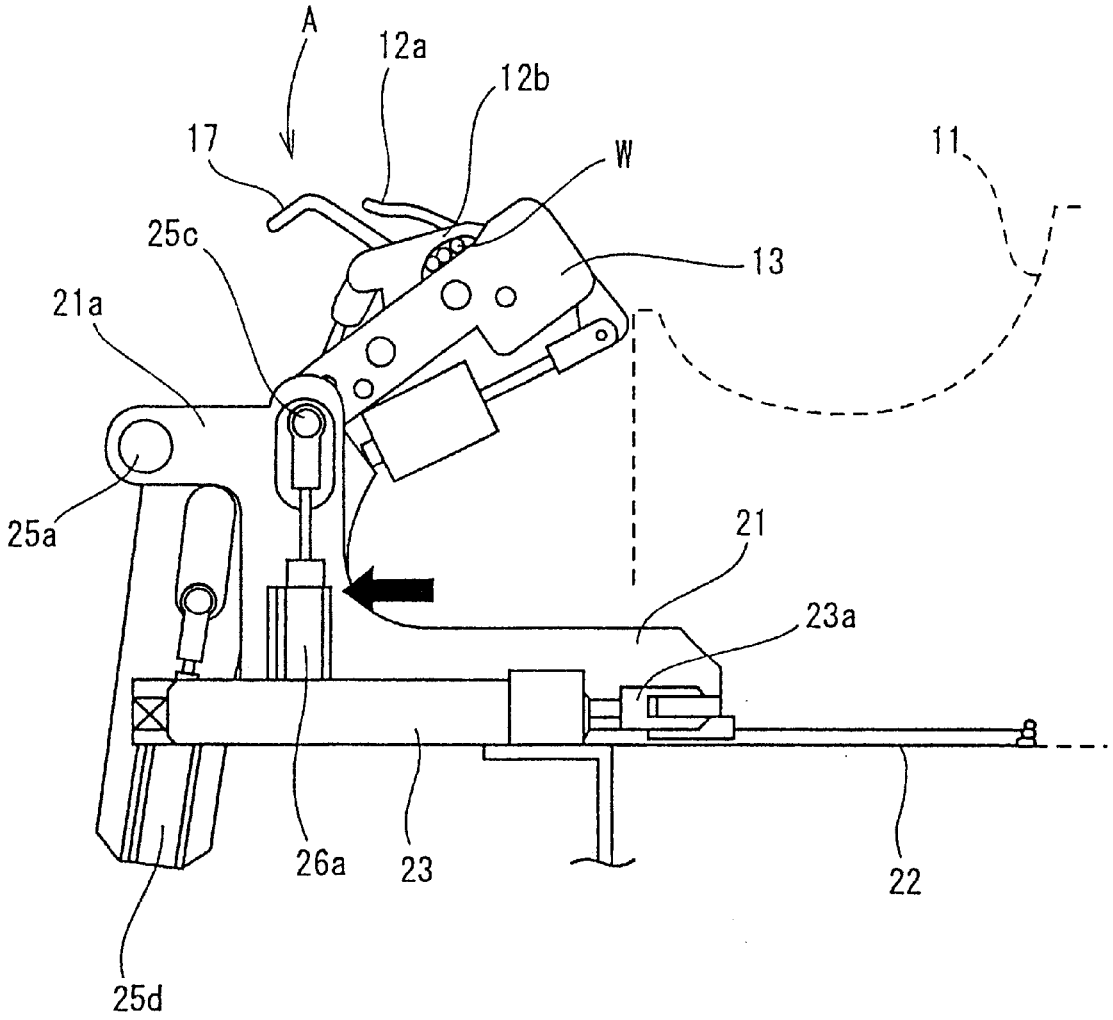
FIG. 8 illustrates the condition in which the bundling pawl mechanism is retracted to a retracted position.
Figure 9:
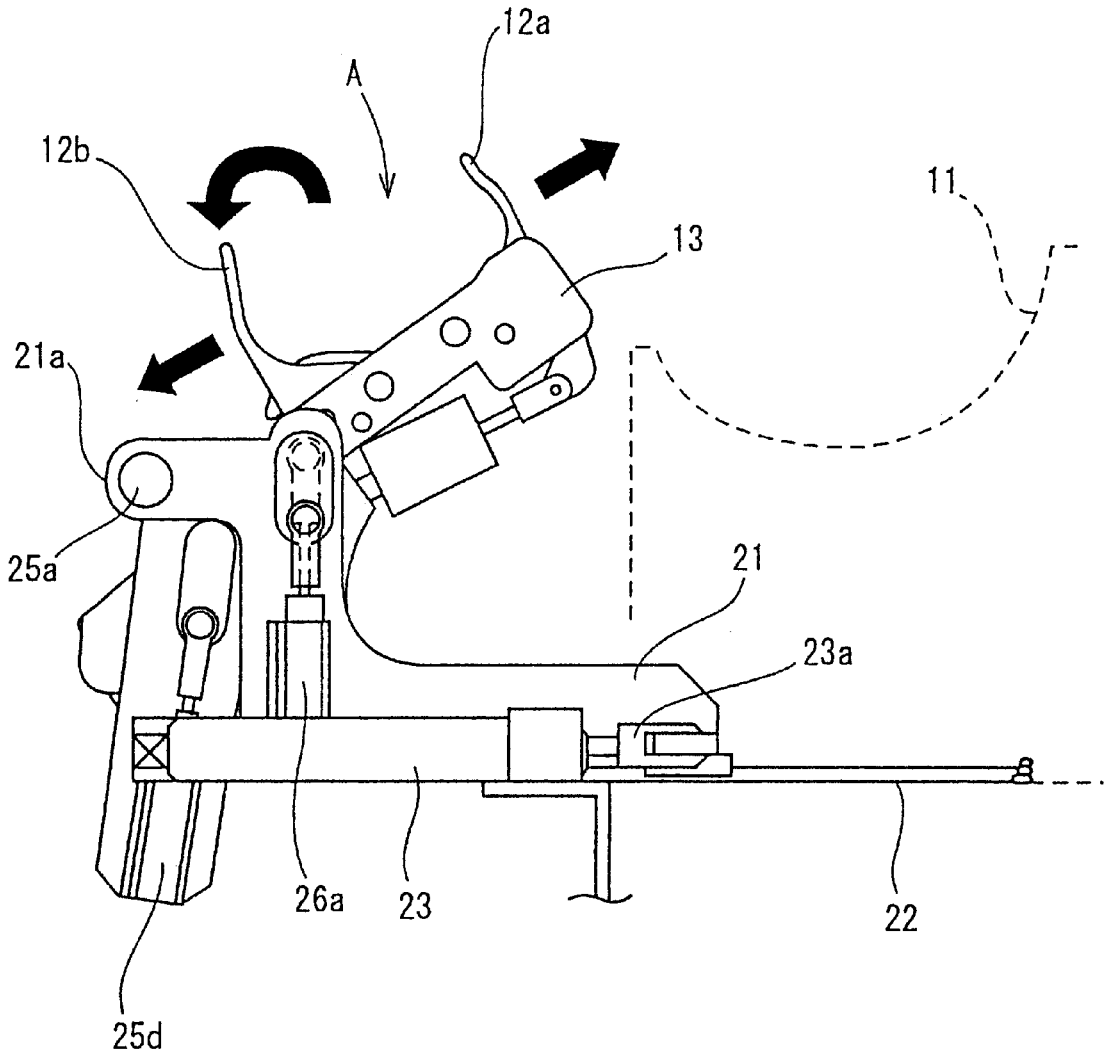
FIG. 9 illustrates the condition in which the pawl members are opened to release the bundled wires.
Figure 10:
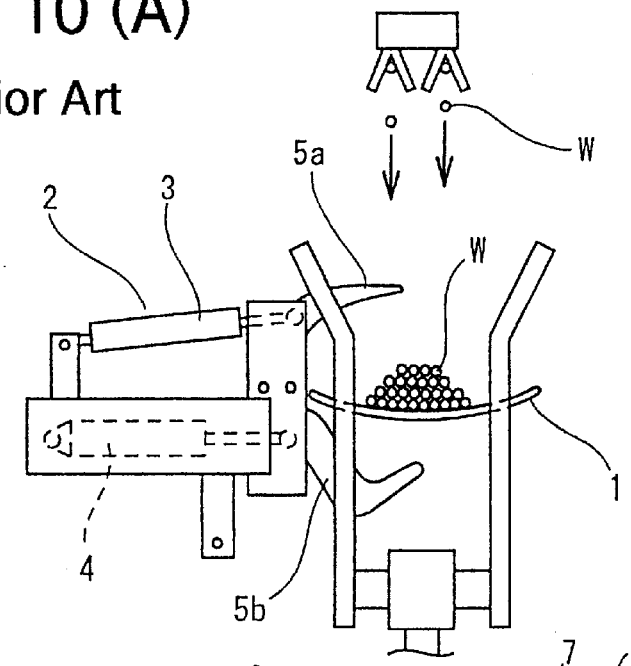
Fig. 10 (A) Prior Art
FIGS. 10(A) through (C) illustrate a conventional wire bundling process.
Figure 10:
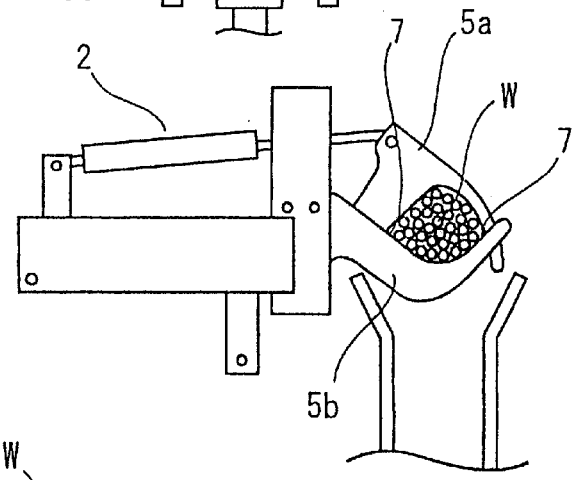
Fig. 10 (B) Prior Art
Figure 10:
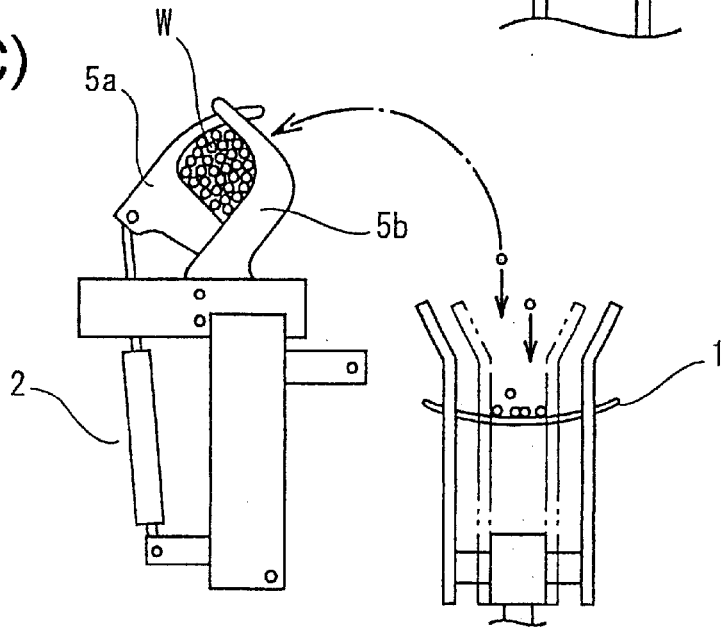
Fig. 10 (C) Prior Art

The rotating mechanism 25 is provided to rotate the entire bundling pawl mechanism 12 upwardly from a wire receiving position C (FIG. 5) to a retracted or wire removing position D (FIGS. 8 and 9). As best shown in FIG. 1, a bracket 25*b* of the rotating mechanism 25 is pivotably supported at its intermediate portion (left upper end) via a pin 25*a* on a support member 21*a* projecting upwardly from the movable frame 21. The bracket 25*b* is further pivotably supported at its one end (right upper end) via a pin 25*c* on an intermediate portion of the support plate 13 of the bundling pawl mechanism 12. A piston rod 25*e* of a fourth cylinder 25*d*, which is fixed at the other end (lower end) of the bracket 25*b* as a rotating means, is connected to the support plate 13 at a position rearwardly of the pin 25*c*. Because of this construction, when the fourth cylinder 25*d* advances or retracts, the bundling pawl mechanism 12, operatively associated with the bracket 25*b*, rotates upwardly from the wire receiving position C (FIG. 5) to the wire removing position D (FIGS. 8 and 9), about the pin 25*c* which functions as a pivot point.

Figure 5:
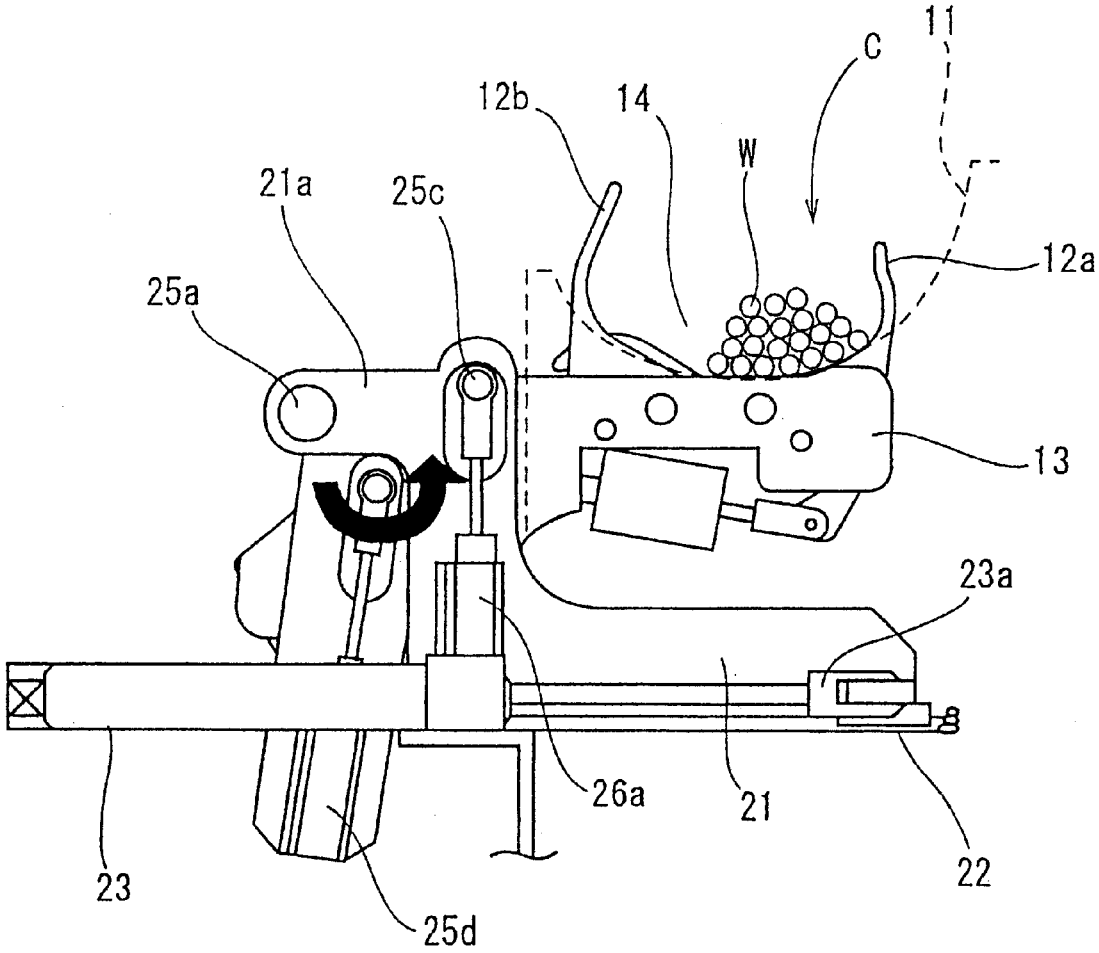
FIG. 5 illustrates the condition in which the bundling pawl mechanism is advanced to a wire receiving position.

As best seen in FIG. 1, the lifting mechanism 26 is provided to elevate and lower the entire bundling pawl mechanism 12. As shown in FIG. 5, the lifting mechanism 26 elevates the pawl members 12*a*, 12*b* from the bundling position B (FIG. 4) below the tray 11 to the wire receiving position C (FIG. 5) so that the pawl members 12*a*, 12*b* can receive the wires W placed on the tray 11. A piston rod 26*b* of a fifth cylinder 26*a*, which is fixed with the support member 21 a as a lift driving mechanism, is connected to the pin 25*c* that pivotably interlocks the bracket 25*b* of the rotating mechanism 25 and the plate 13 of the bundling pawl mechanism 12. Therefore, when the fifth cylinder 26*a* advances or retracts, the bracket 25*b* rotates about the pin 25*a*, and thus elevates or lowers the bundling pawl mechanism 12.

The operation of the bundling apparatus 10 of the above construction, i.e., the operation of bundling and removing the wires from the receiving tray 11, will be described below. As shown in FIG. 3, the bundling pawl mechanism 12 is disposed in the retracted position A with the pair of pawl members 12*a*, 12*b* in the opening position and with the catch prevention member 17 in a retracted position extending in overlying or intersecting relation with the pawl member 12*b*. The processed wires W are fed downwardly, and placed on the tray 11 in a successive manner. In this condition, the third cylinder 23 extends to advance the movable frame 21, thereby shifting the bundling pawl mechanism 12 from the retracted position A to the bundling position B as shown in FIG. 4. During this process, the upper end of the pawl member 12*b* contacts the wires W accumulated on the tray 11, and moves them so that they can be gathered at one side or location.

Figure 6:
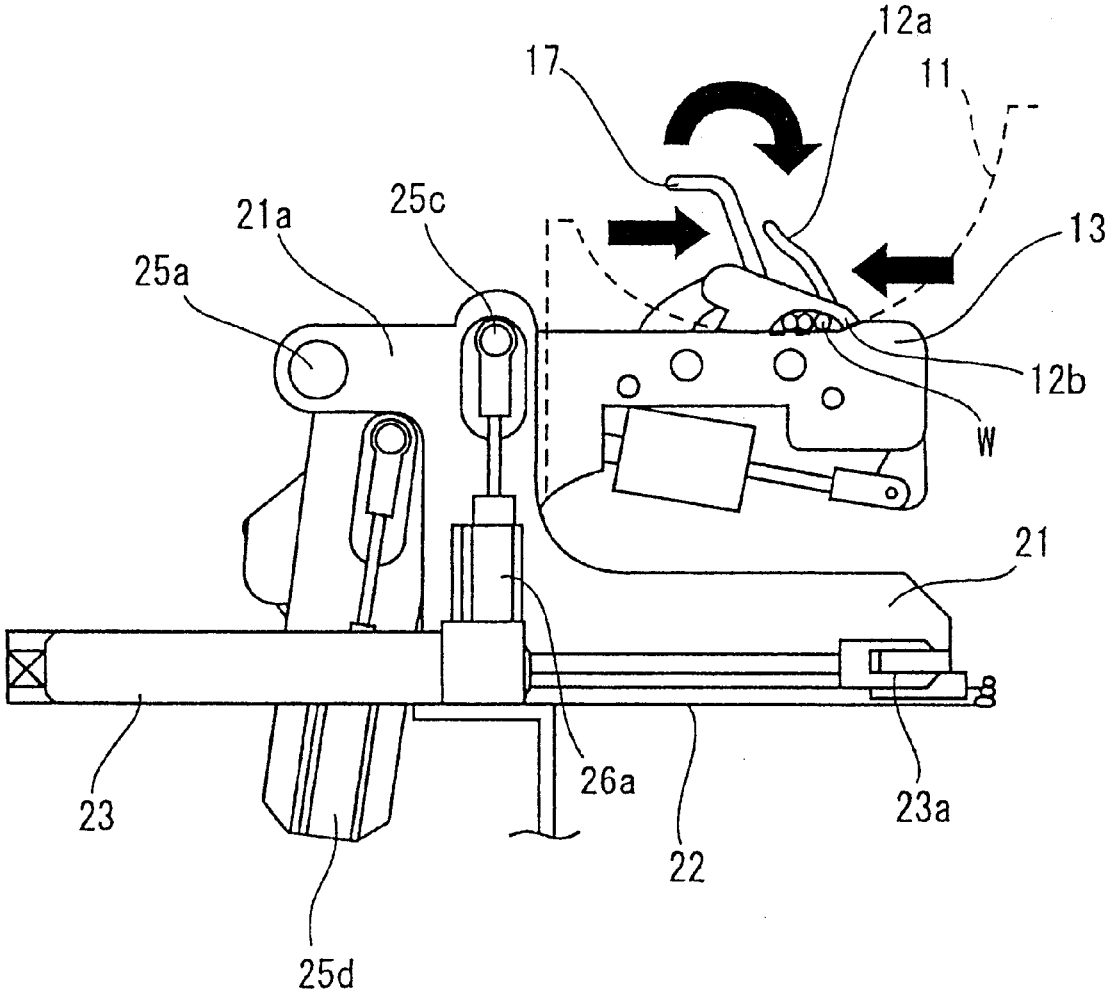
FIG. 6 illustrates the condition in which the pawl members are closed in the wire receiving position.

Subsequently, as shown in FIG. 5, the fifth cylinder 26*a* of the lifting mechanism 26 extends upwardly so that the bracket 25*b* rotates in a counterclockwise direction about the pin 25*a* which functions as a pivot point. When the bracket 25*b* rotates in the counterclockwise direction, the bundling pawl mechanism 12, operatively associated with the bracket 25*b*, also rotates in the same direction, thereby lifting the pawl members 12*a*, 12*b* to the receiving position C where the wires W gathered on the tray 11 can be received between the pawl members 12*a*, 12*b*. As this condition has been reached, the first and second cylinders 15, 16 of the bundling pawl mechanism 12 extend so that both of the pawl members 12*a*, 12*b* rotate toward each other in the closing direction, thereby bundling the wires W in the bundling region 14 as shown in FIG. 6(and FIGS. 2(B) and 2(C)). In the above-mentioned process, as the pawl member 12*b* rotates in the closing direction, the engaging portion 17*b* is brought into operative engagement with the catch prevention member 17. As a result, the catch prevention member 17 projects away from the angled inner corner 14*a* (FIG. 2(B)) into the bundling region 14, thereby forming an obtuse angle at the inner corner 14*a*. Therefore, the wires W, which would otherwise become caught in the inner corner 14*a* that decreases the degree of its angle as the closing operation progresses, are forcibly pushed away toward the center of the bundling region 14 by the catch prevention member 17, thereby preventing the wires W from becoming caught and damaged.

Figure 7:
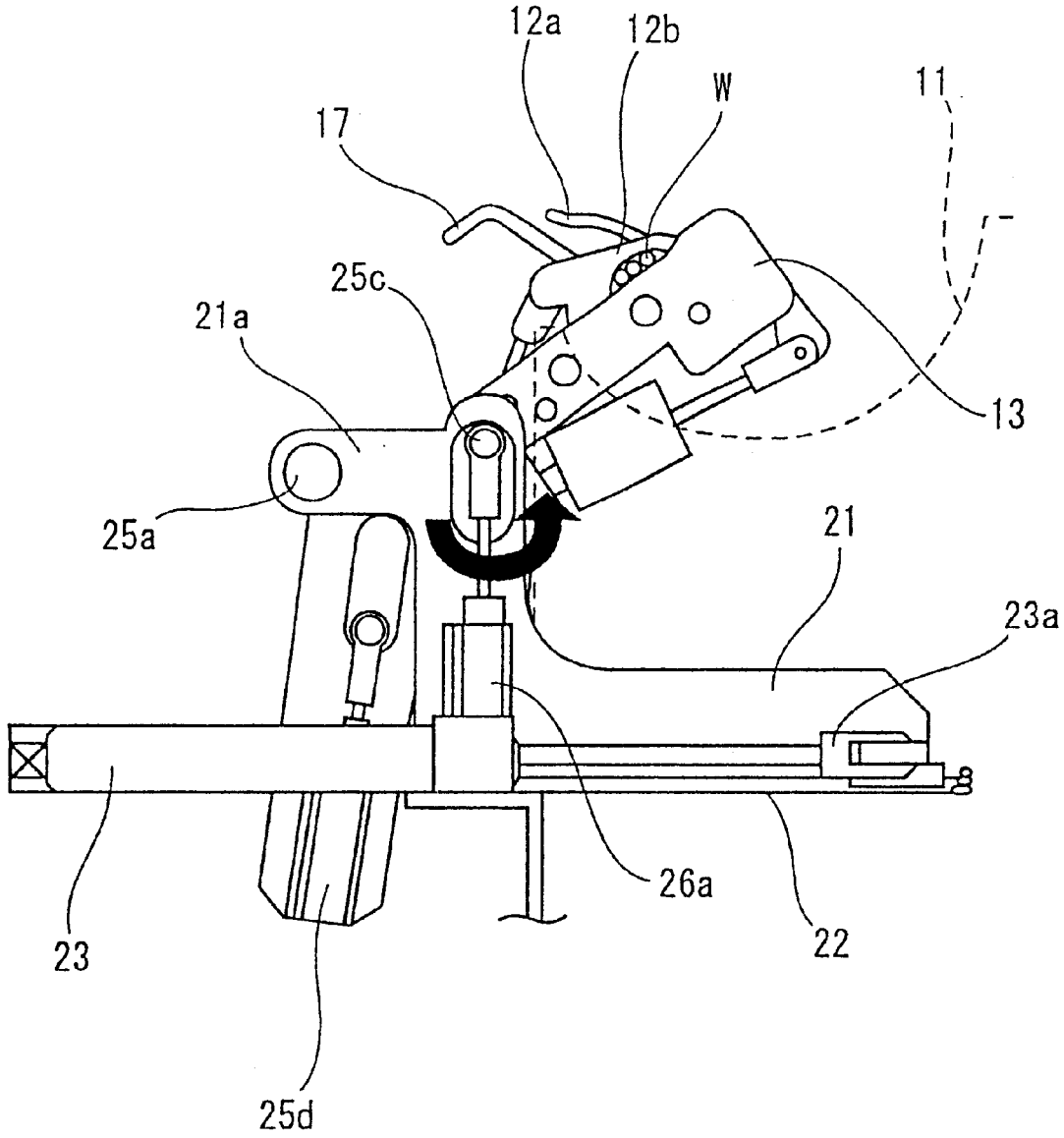
FIG. 7 illustrates the condition in which the bundling pawl mechanism is rotated upwardly.

Thereafter, the fourth cylinder 25*d* of the rotating mechanism 25 is retracted or lowered as shown in FIG. 7. Thus, the bundling pawl mechanism 12 rotates about the pin 25*c* in the counterclockwise direction, thereby lifting the wires W enclosed and bundled by the pawl members 12*a*, 12*b*, from the receiving tray 11. In this condition, as shown in FIG. 8, the third cylinder 23 of the movable frame 21 is retracted so that the entire bundling pawl mechanism 12 is retracted to a retracted position A with the movable frame 21. Then, the first and second cylinders 15, 16 of the bundling pawl mechanism 12 are retracted as shown in FIG. 9. Therefore, the pawl members 12*a*, 12*b* open, and the catch prevention member 17 retracts toward the pawl member 12*b* by the action of the spring 17*c*, thereby releasing and removing the wires W from the pawl members 12*a*, 12*b*.

In the above embodiments, the catch prevention member 17 is provided only in the angled inner corner 14*a* formed between the rearwardly disposed pawl member 12*b* and the upper edge portion 13*c* of the support plate 13. However, another catch prevention member may also be provided at the side of the forwardly disposed pawl member 12*a*. As has been described in the above embodiments, the bundling pawl mechanism 12 rotates upwardly via the rotating mechanism 25 to lift the bundled wires W from the receiving tray 1, and retracts to the retracted position A (FIG. 8). However, it may also be retracted to the retracted position A (FIG. 3) without lifting the bundled wires W from the receiving tray 1. However, if there is a possibility that the bundled wires W which would hang downwardly would interfere with surrounding mechanisms units, it would be preferable to lift the bundling pawl mechanism 12 via the rotating mechanism 25.

As will be understood from the foregoing description, when the pawl members close to bundle the wires, the catch prevention member projects to push the wires, positioned in or near the angled inner corner, toward the center of the bundling region. Thus, the wires can be prevented with certainty from becoming caught in the corner and thus from becoming damaged. Additionally, the pawl members are respectively supported at two spaced apart pivot points, so that the wire receiving region becomes large enough to receive all the required wires. This ensures that the pawl members enclose and bundle all the required wires. Moreover, when the bundling pawl mechanism moves from the retracted position to the bundling position, one of the pawl members contacts the wires placed on the tray and moves them, thereby gathering the wires, which may be scattered on the tray, and bundling all the required wires with certainty.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. TOKUGAN 2000-10309, filed on Apr. 5, 2000, which is herein expressly incorporated by reference in its entirety.

What is claimed is:

1. An apparatus for bundling a plurality of wires placed on a receiving plate, said apparatus comprising a bundling pawl mechanism including: a plate, a pair of pawl members respectively supported at pivot points provided on said plate in spaced-apart relation and interconnected with driving units for opening and closing movement, said pawl members respectively extending beyond an edge portion of said plate, wherein a wire bundling region is formed between inner surfaces of said pawl members and said edge portion of said plate when at least one of said pawl members rotates toward the other of said pawl members in a closing direction, a wire catch prevention member configured to project into the wire bundling region from an angled inner corner formed between the inner surface of said at least one pawl member and said edge portion of said plate when said at least one pawl member rotates in the closing direction, so that the wires can be prevented from becoming caught in the angled inner corner, thereby preventing the wires from becoming damaged in the angled inner corner.

2. The apparatus according to claim 1, wherein said wire catch prevention member is pivotably supported at a pivot point provided on said plate, wherein said at least one pawl member includes an engaging portion that operatively engages and pushes said wire catch prevention member into the wire bundling region when said at least one pawl member rotates in the closing direction.

3. The apparatus according to claim 1, further comprising a movable frame that supports and moves said bundling pawl mechanism between a retracted position which is located outwardly of the receiving tray and a bundling position which is located below the receiving tray, wherein said bundling pawl mechanism is configured to be lifted from the bundling position to a wire receiving position which corresponds to the receiving tray via a lifting mechanism, whereby said pawl members can receive the wires placed on the receiving tray.

4. The apparatus according to claim 3, further comprising a rotating mechanism that supports said bundling pawl mechanism so that said bundling pawl mechanism rotates upwardly from the receiving position when said bundling pawl mechanism removes the wires from the receiving tray, whereby the wires that hang downwardly from said bundling pawl mechanism can be prevented from interfering with surrounding units.

5. The apparatus according to claim 1, further comprising a movable frame that supports and moves said bundling pawl mechanism between a retracted position which is located outwardly of the receiving tray and a bundling position which is located below the receiving tray, wherein said at least one pawl member is disposed farther away from the receiving tray than the other of said pawl members in a direction in which said bundling pawl mechanism moves from the retracted position to the bundling position, wherein said at least one pawl member is configured to contact the wires placed on the receiving tray when said bundling pawl mechanism moves to the bundling position, whereby the wires can be gathered at one location on the receiving tray.

6. A method of bundling a plurality of wires which are to be fed on a receiving plate and removing the wires from the receiving tray, said method comprising:

providing a bundling pawl mechanism having a plate and a pair of pawl members supported on said plate for opening and closing movement, gathering the wires at one location on the receiving tray by moving one of said pawl members into contact with the wires placed on the receiving tray while advancing said bundling pawl mechanism from a retracted position which is located outwardly of the receiving tray to a bundling position which is located below the receiving tray, lifting said bundling pawl mechanism from the bundling position to a wire receiving position which is located laterally adjacent the receiving tray, whereby the gathered wires can be received between said pawl members when said bundling pawl mechanism is lifted, closing said pawl members and forming a wire bundling region between inner surfaces of said pawl members and an edge portion of said plate, thereby enclosing and bundling the wires in said wire bundling region, retracting said bundling pawl mechanism to a position where said pawl members are disposed outwardly of said receiving tray, and opening said pawl members to release and remove the bundled wires.

7. The method according to claim 6, further comprising:

providing a wire catch prevention member in an angled inner comer formable between the inner surface of at least one of said pawl members and an edge portion of said plate, and projecting said wire catch prevention member into said wire bundling region from the angled inner comer when said at least one pawl member moves in a closing direction, so that the wires can be prevented from becoming caught in the angled inner corner.

8. An apparatus for bundling a plurality of wires placed on a receiving plate, said apparatus comprising a bundling pawl mechanism including:

a plate having an edge portion, a pair of pawl members pivotably supported on said plate and extending beyond said edge portion, said pawl members forming a wire accommodating region between inner surfaces thereof and said edge portion when said pawl members are positioned away from each other in a opening condition, and forming a wire bundling region between the inner surfaces thereof and said edge portion when at least one of said pawl members rotates toward the other of said pawl members in a closing direction, wherein said at least one pawl member is configured to form an angled inner corner between the inner surface thereof and said edge portion when said at least one pawl member rotates toward the other of said pawl members in the closing direction, a wire catch prevention member configured to form an obtuse angle between the inner surface of said at least one pawl member and said edge portion when said at least one pawl member rotates toward the other of said pawl members to enclose and bundle the wires, whereby the wires can be prevented from becoming caught in said angled inner corner, thereby preventing the wires from becoming damaged while the wires are being enclosed and bundled.

9. The apparatus according to claim 8, wherein said wire catch prevention member is configured to project from said angled inner corner into the wire bundling region when said at least one pawl member rotates toward the other of said pawl members in the closing direction, so that the obtuse angle can be formed between the inner surface of said at least one pawl member and said edge portion, thereby preventing the wires from becoming caught in said angled inner corner.

10. The apparatus according to claim 9, wherein said wire catch prevention member is pivotably mounted on said plate between said pawl members provided in spaced-apart relation, and extends to overly said at least one pawl member in intersecting relation, whereby said wire catch prevention member is pushed into the wire bundling region when said at least one pawl member rotates toward the other of said pawl members.

11. The apparatus according to claim 10, wherein said wire catch prevention is positioned in said inner angled corner when said pawl members are in the opening condition, and rotates into the wire bundling region when said at least one pawl member rotates toward the other of said pawl members while decreasing the angle of said inner angled corner.

12. The apparatus according to claim 10, wherein said wire catch prevention member is biased toward said at least one pawl member and away from the other of said pawl members and wherein said at least one pawl member is configured to push said wire catch prevention member while sliding along said wire catch prevention member when said at least one pawl member rotates toward the other of said pawl members in the closing direction.

13. The apparatus according to claim 11, wherein said wire catch prevention member is biased toward said at least one pawl member and away from the other of said pawl members and wherein said at least one pawl member is configured to push said wire catch prevention member while sliding along said wire catch prevention member when said at least one pawl member rotates toward the other of said pawl members in the closing direction.

14. The apparatus according to claim 9, wherein said at least one pawl member includes an engaging portion that operatively engages and rotates said wire catch prevention member into the wire bundling region when said at least one pawl member rotates in the closing direction, wherein said wire catch prevention member pushes the wires toward the center of the wire bundling region during its movement.

15. The apparatus according to claim 12, wherein said at least one pawl member includes an engaging portion that operatively engages and rotates said wire catch prevention member into the wire bundling region when said at least one pawl member rotates in the closing direction, wherein said wire catch prevention member pushes the wires toward the center of the wire bundling region during its movement.

16. The apparatus according to claim 13, wherein said at least one pawl member includes an engaging portion that operatively engages and rotates said wire catch prevention member into the wire bundling region when said at least one pawl member rotates in the closing direction, wherein said wire catch prevention member pushes the wires toward the center of the wire bundling region during its movement.

17. The apparatus according to claim 8, further comprising a movable frame that supports and moves said bundling pawl mechanism from a retracted position to a wire bundling position, wherein said at least one pawl member is configured such that its protruding end contacts and moves the wires placed on the receiving tray when said bundling pawl mechanism shifts toward the wire bundling position, whereby the wires can be gathered at one location on the receiving tray.

18. The apparatus according to claim 9, further comprising a movable frame that supports and moves said bundling pawl mechanism from a retracted position to a wire bundling position, wherein said at least one pawl member is configured such that its protruding end contacts and moves the wires placed on the receiving tray when said bundling pawl mechanism shifts toward the wire bundling position, whereby the wires can be gathered at one location on the receiving tray.

* * * * *

UNITED STATES PATENT AND TRADEMARK OFFICE

CERTIFICATE OF CORRECTION

PATENT NO. : 6,463,849 B2
DATED : October 15, 2002
INVENTOR(S) : T. Mizutani

It is certified that error appears in the above-identified patent and that said Letters Patent is hereby corrected as shown below:

Column 11,
Lines 8 and 12, “comer” should be -- corner --.

Signed and Sealed this

Tenth Day of June, 2003

JAMES E. ROGAN
*Director of the United States Patent and Trademark Office*